US005472046A

United States Patent [19]

Brücher et al.

[11] Patent Number: 5,472,046

[45] Date of Patent: Dec. 5, 1995

[54] HEAT EXCHANGER FOR COOLING HOT REACTION GAS

[75] Inventors: Peter Brücher; Helmut Lachmann, both of Berlin, Germany

[73] Assignee: Deutsche Babcock-Borsig Aktiengesellschaft, Berlin, Germany

[21] Appl. No.: 350,948

[22] Filed: Dec. 7, 1994

[30] Foreign Application Priority Data

Mar. 8, 1994 [DE] Germany ..... 44 07 594.4

[51] Int. Cl.[6] ..... F28F 9/02

[52] U.S. Cl. ..... 165/134.1; 165/158

[58] Field of Search ..... 165/134.1, 158; 122/512

[56] References Cited

U.S. PATENT DOCUMENTS 4,245,696 1/1981 Van der Lelij ..... 165/134.1
4,700,773 10/1987 Kelhrer ..... 165/134.1
5,035,283 7/1991 Brücher et al. ..... 165/134.1
5,088,551 2/1992 Brücher et al. ..... 165/134.1

*Primary Examiner*—Allen J. Flanigan
*Attorney, Agent, or Firm*—Max Fogiel

[57] ABSTRACT

A heat exchanger for cooling hot reaction gas with a coolant. The exchanger rests on a gas-supply chamber (4) and has gas pipes (8). The pipes extend individually out of a wall (1) that surrounds the pipes and are accommodated in a pipe-slab floor (6) between the wall and the chamber. The pipes extend through bores (20) in the floor leaving an annular gap (21). At least one coolant-supply line (9) terminates on the side of the floor facing away from where the gas enters. Chambers (12) demarcated by a flat bottom (15), by a partition (13) that parallels the pipes, and by part of a wall-mounted ring (14) are accommodated in the half of the floor facing the side where the gas enters. The chambers communicate with a common coolant supply. One or more gas pipes (8) extends through every such chamber. The ring is positioned at the edge of the floor and surrounds all the chambers. The floor comprises a thinner section (18) that is cooled by the coolant and constituted by the bottoms of all the chambers and a thicker and rigid section (19) that the thinner section rests on by way of the partitions.

12 Claims, 5 Drawing Sheets

HEAT EXCHANGER FOR COOLING HOT REACTION GAS

BACKGROUND OF THE INVENTION

The present invention concerns a heat exchanger for cooling hot reaction gas.

A heat exchanger of this genus is known from European Patent 436 828. It is employed for cooling reaction gas from an oil-gasification plant. It has a pipe-slab floor that accommodates cylindrical cooling channels with a gas pipe extending through each. Due to the geometry of the channels, the coolant flowing through them cools the gas-intake side of the floor irregularly. There are bores through the floor between the channels to distribute the cooling action more uniformly, but the result is not entirely satisfactory.

European Patent 417 428 discloses a heat exchanger for cooling cracked gas. Cracked gas must be cooled very rapidly to stabilize the internal reaction and ensure a satisfactory yield. This heat exchanger accordingly includes a number of fairly slender pipes combined into a package employed in two floors. Each pipe in one series extends through a single coolant channel. The channels are distributed throughout the floor such as to leave a thinner section of floor at the gas-intake side supported on partitions between the coolant channels on a thicker section.

SUMMARY OF THE INVENTION

The object of the present invention is a generic heat exchanger with an improved floor that will be rigid enough to withstand the pressure of the coolant and will ensure effective and uniform cooling where the pipes communicate with the floor.

The chambers create a floor that satisfies the proposed requirements in that they divide it into a thinner section that is easier to cool and a thicker and more rigid section that functions as a support. The coolant washes over the walls of the chambers as it enters them, cooling them effectively and contributing to the further cooling of the thinner section.

BRIEF DESCRIPTION OF THE DRAWINGS

Several embodiments of the invention will now be specified with reference to the accompanying drawing, wherein.

DESCRIPTION OF THE PREFERRED EMBODIMENTS

Figure 1:
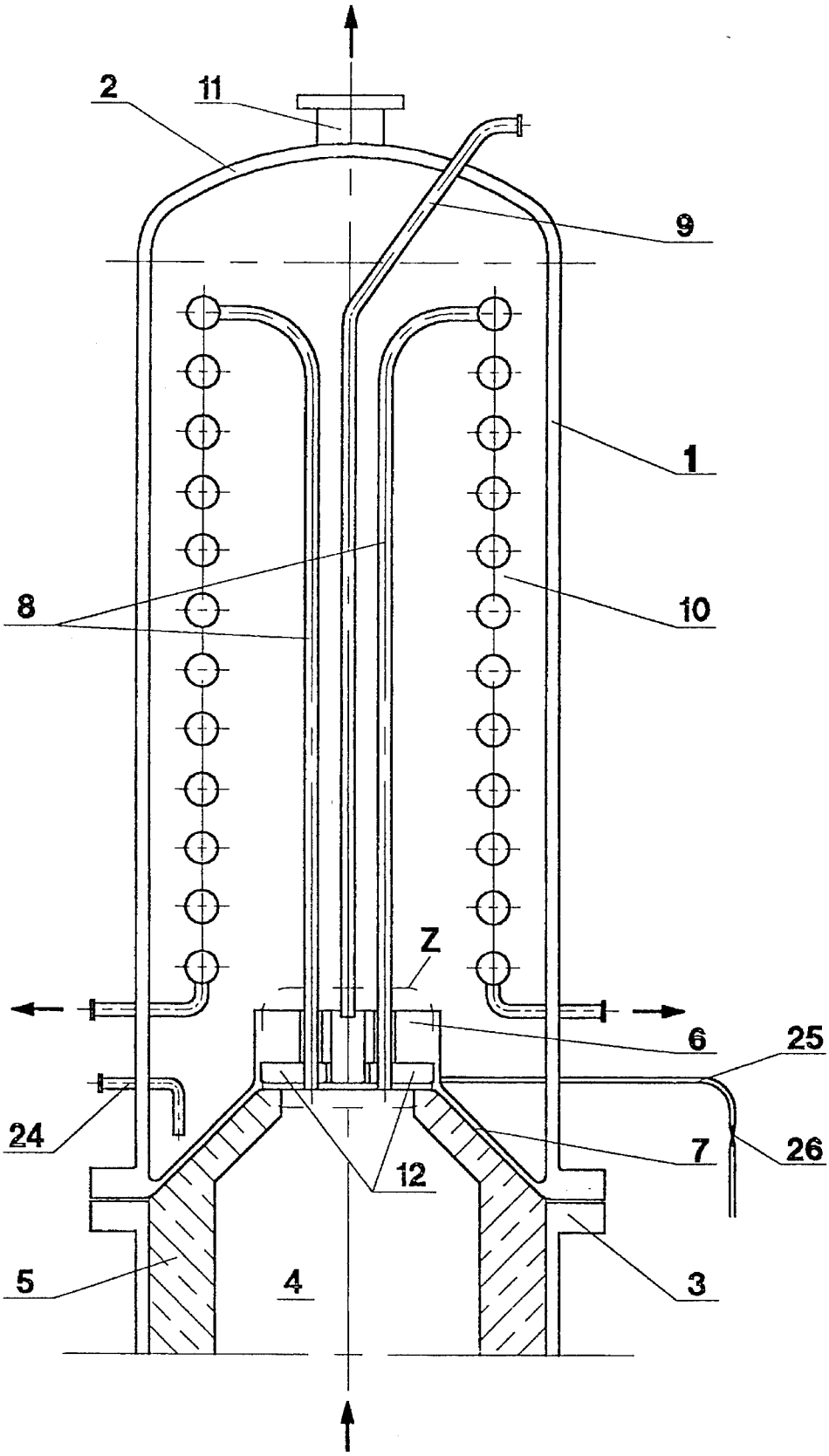
FIG. 1 is a schematic longitudinal section through a heat exchanger.
Figure 2:
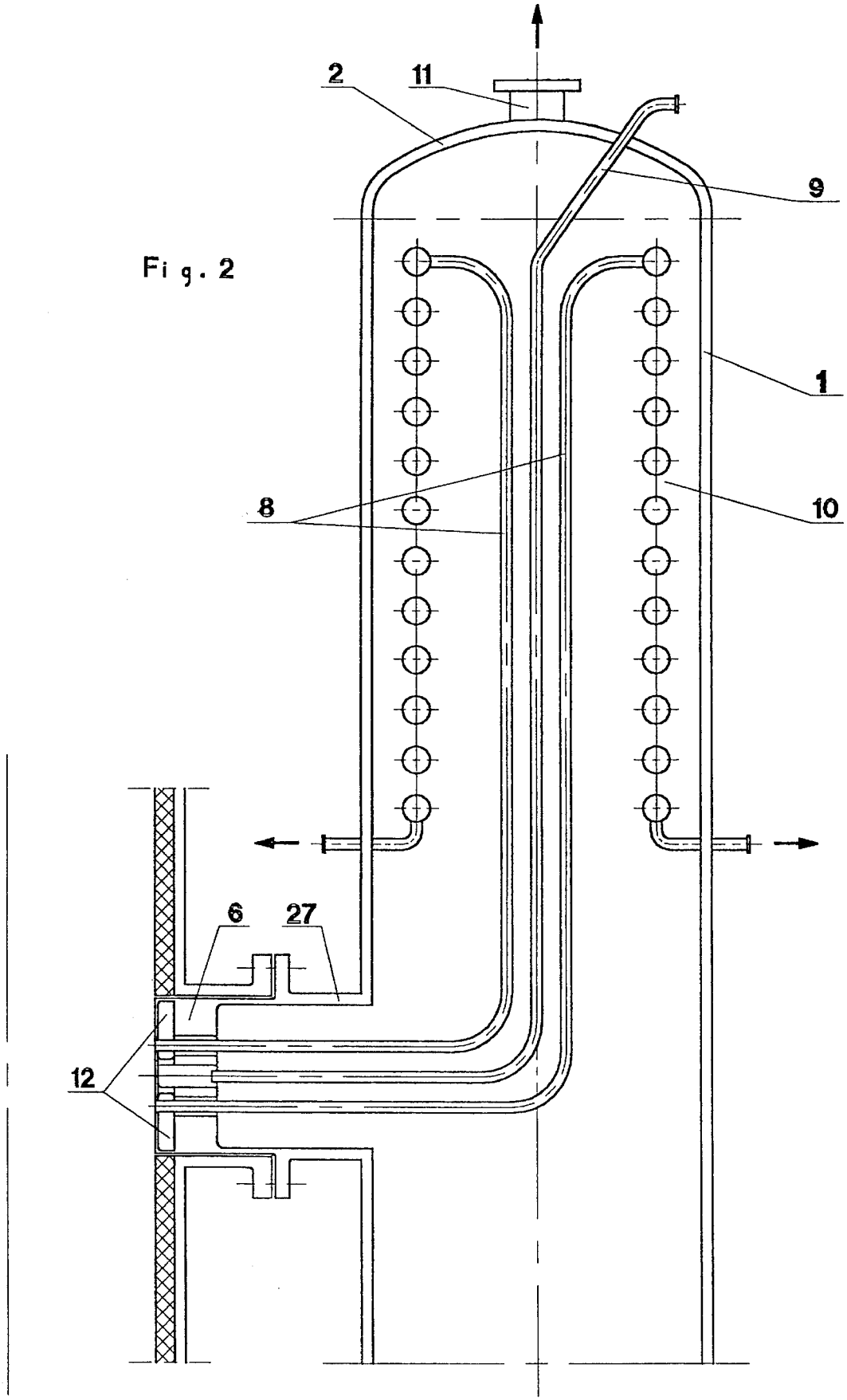
FIG. 2 is a schematic longitudinal section through another type of heat exchanger.
Figure 3:
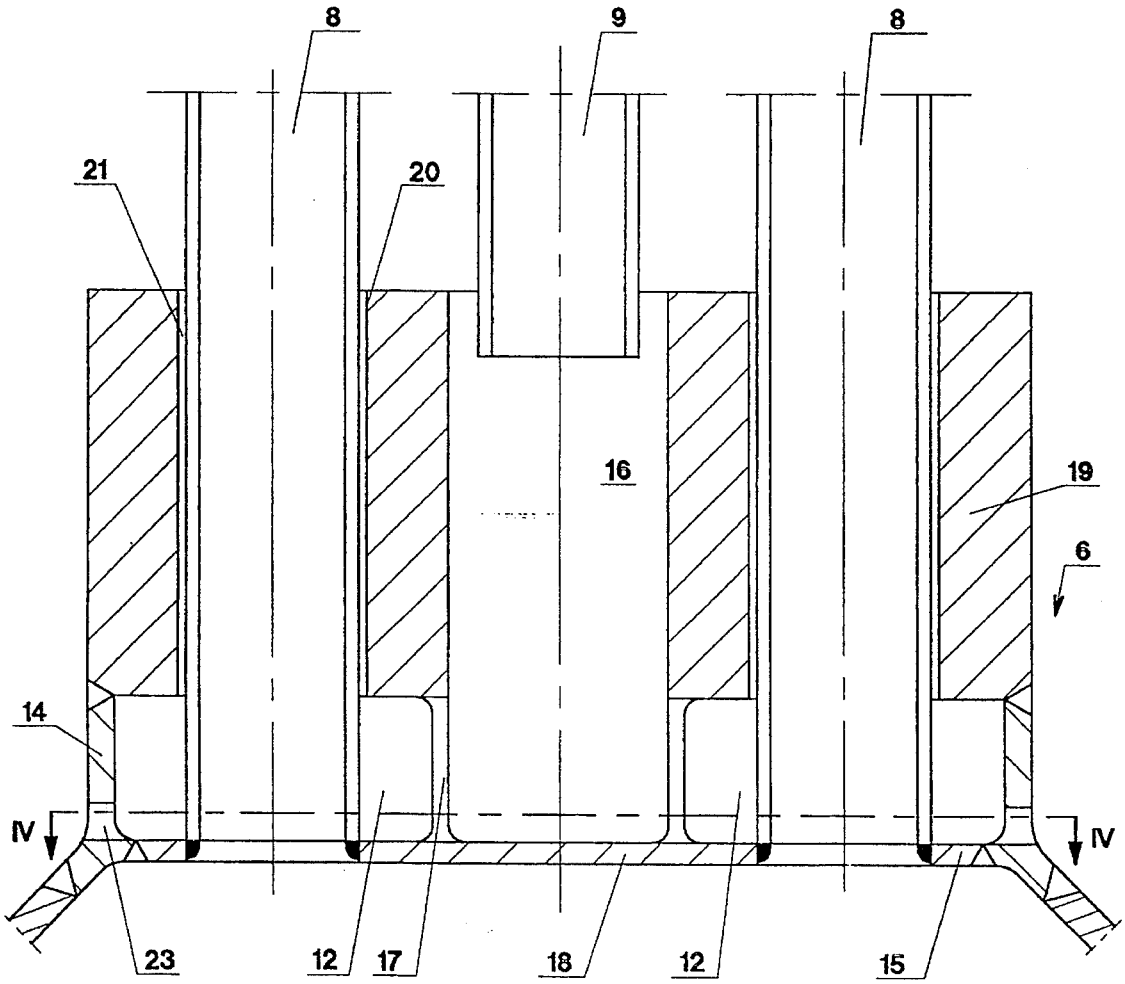
FIG. 3 is a larger-scale rendering of the detail Z in FIG. 1.

The heat exchanger is an upright heat exchanger. It has an outer wall 1 and a domed top 2 and is surrounded by a flange 3 at the bottom. The heat exchanger rests on a gas-supply chamber 4 with a fireproof lining. An unillustrated pressurized reactor, which can be part of an oil-gasification plant, communicates with chamber 4.

The wall 1 of the heat exchanger is separated from gas-supply chamber 4 by a pipe-slab floor 6. The diameter of floor 6 is shorter than that of wall 1. Floor 6 is connected to the flange 3 constituting the bottom edge of wall 1 by a sheet in the form of an inward-pointing cone 7 such that floor 6 is above flange 3. Cone 7 has a fireproof lining 5 like that of gas-supply chamber 4.

Pipes 8 are inserted in floor 6 and extend straight up into the vicinity of top 2. Each pipe 8 coils as it leaves the top. The end of each coil leaves wall 1 just above floor 6. The gas leaving gas-supply chamber 4 flows through pipes 8 while subjected to a coolant. The coolant is supplied to the interior 10 of the heat exchanger as will be specified hereinafter over a line 9. The coolant is compressed water that vaporizes as it comes into contact with the hot gas and leaves in the form of steam through an outlet 11 in top 2.

Figure 4:
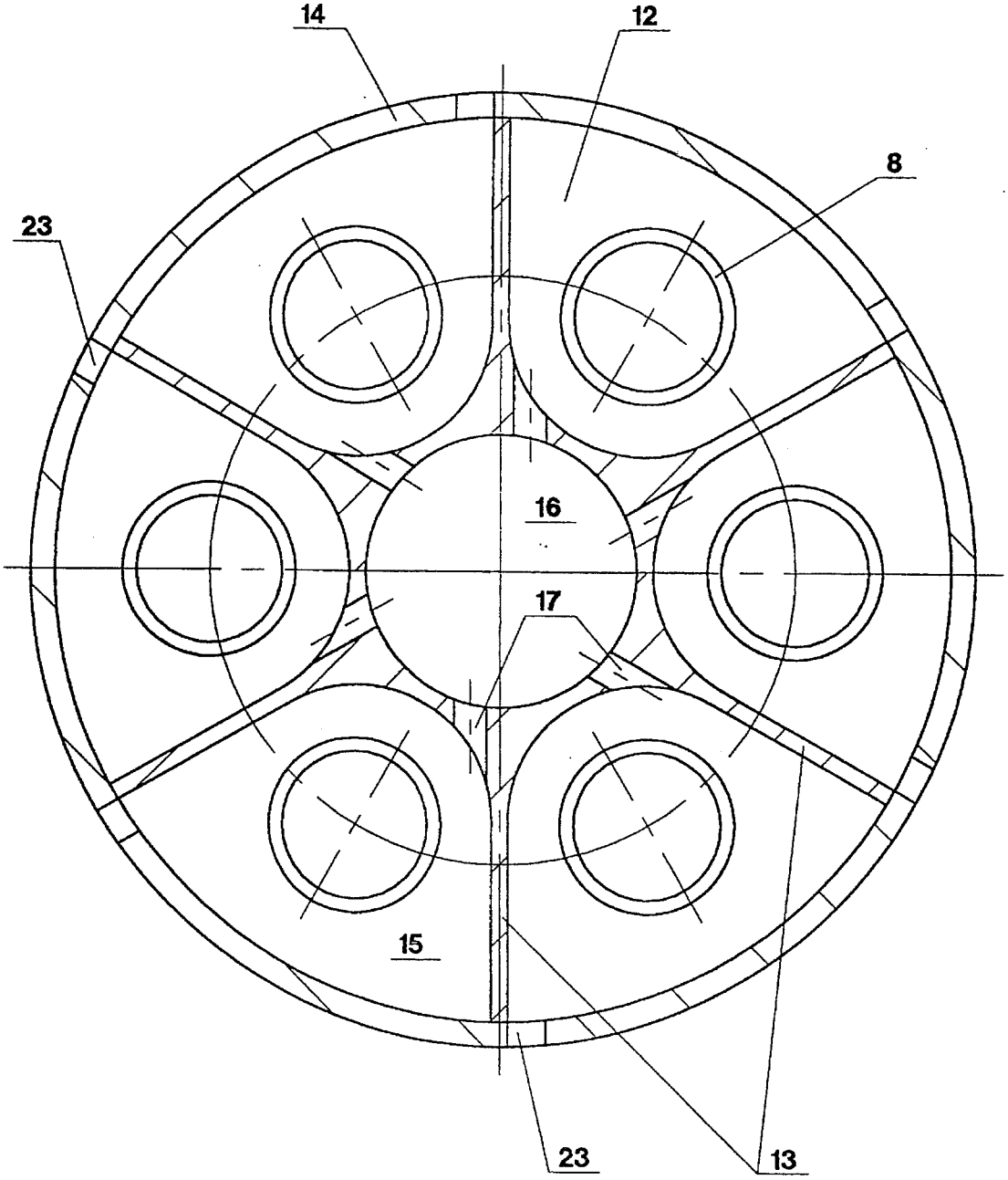
FIG. 4 is a section along the line IV—IV in FIG. 3.

Chambers 12 are milled or electrochemically machined into the side of floor 6 facing gas-supply chamber 4. Chambers 12 are shaped like pits and, as will be evident from FIG. 4, extend radially out from the longitudinal central axis of the heat exchanger. Each chamber 12 is demarcated from the center of floor 6 and from its adjacent chamber 12 by a partition 13 that parallels gas pipe 8. Chambers 12 open toward the edge of floor 6 and are closed off by a wall-mounted ring 14. Ring 14 is welded tight to cone 7 and to the hereinafter specified thicker section of floor 6. The bottom 15 of each chamber 12 is flat.

Coolant-supply line 9 opens into a coolant-supply chamber 16 demarcated by the partitions 13 between chambers 12. Each chamber 12 communicates with coolant-supply chamber 16 by way of a slot 17 extending from top to bottom of each partition 13. It is preferable for slot 17 to extend at a tangent to chamber 12 to allow the coolant to enter each chamber 12 from supply chamber 16 at a tangent.

Chambers 12 are distributed throughout floor 6 in such a way as to produce a thinner floor section 18 on the gas-intake side and a thicker floor section 19 on the side facing the interior 10 of the heat exchanger. Thinner floor section 18 is accordingly effectively cooled by the coolant entering chambers 12. Thicker floor section 19 is rigid enough to accommodate the pressure exerted by the coolant. Thinner floor section 18 rests on thicker floor section 19 by way of the partitions 13 between chambers 12.

Pipes 8 are welded tight into thinner floor section 18. Every pipe 8 in the embodiment illustrated in FIGS. 1 and 4 extends through a chamber 12. The top of chambers 12 is constituted by thicker floor section 19. Section 19 is provided with bores 20, each of which accommodates a single pipe 8 loosely enough to leave an annular gap 21. The coolant leaving supply line 9 enters supply chamber 16 and arrives in chambers 12 through slots 17 and in interior 10 through gaps 21. The tangential orientation of slots 17 imposes a twist on the entering coolant and accordingly generates turbulence in gaps 21. It is this situation that makes tangential intake particularly practical, although other orientations, radial for example, are also possible.

Figure 5:
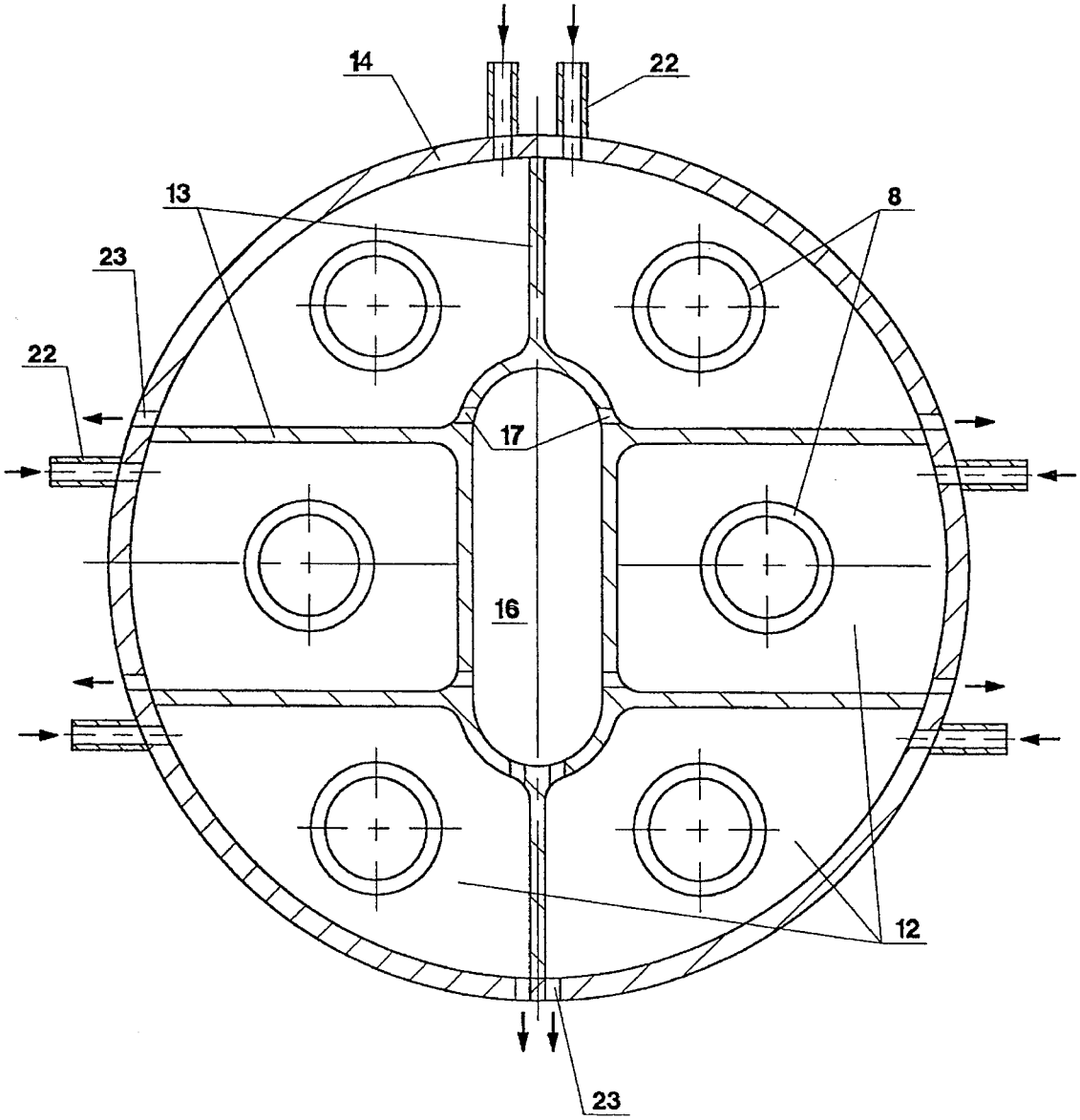
FIG. 5 is a top view of the floor in still another embodiment.

FIG. 5 illustrates a floor 6 with an elongated supply chamber 16 and non-radial chambers 12. In addition to communication with central supply chamber 16, there is an intake 22 at the circumference of every chamber 12, through which additional coolant is supplied to the chamber from an unillustrated specific connection or circulation system. Supplying coolant from both inside and outside generates particularly satisfactory turbulence in the chambers, improving the transfer of heat from the hot gas to the coolant.

There is a port 23 in each section of wall-mounted ring 14 that demarcates a chamber 12. Any solids that accumulate on the bottom 15 of the chamber can be removed through port 23 entrained by some of the coolant. Port 23 is small enough to allow only a little coolant to actually escape. The extracted solids will accumulate at the deepest point of interior 10 between cone 7 and wall 1. The solids can be removed from the heat exchanger at that point by way of a vacuum line 24. A line 25 extending out through wall 1 and through a sludge-removal valve 26 can also be attached to port 23.

Although the aforesaid pipe-slab floor 6 is horizontal, it can also be installed vertical and communicate with a lateral connection 27 that branches off wall 1. In this embodiment the line 25 with the sludge-removal valve 26 is attached only to the lowest chamber 12.

We claim:

1. A heat exchanger for cooling hot reaction gas with a coolant, comprising: an exchanger resting on a gas-supply chamber and having gas pipes extending individually out of a wall surrounding said pipes and being accommodated in a pipe-slab floor between said wall and said chamber; said pipes extending through bores in the floor leaving an annular gap, at least one coolant-supply line terminating on a side of the floor facing away from where the gas enters; chambers demarcated by a flat bottom, by a partition that parallels the pipes, and by part of a wall-mounted ring, said chambers being accommodated in a half of the floor facing a side where the gas enters and communicating with a common coolant supply, at least one gas pipe extending through each said chambers, said ring being positioned at an edge of the floor and surrounding all said chambers, said floor comprising a thinner section cooled by said coolant and formed by bottoms of all said chambers and a thicker and rigid section that said thinner section rests on by said partition.

2. A heat exchanger as defined in claim 1, wherein said chambers are radial.

3. A heat exchanger as defined in claim 2, including a central supply chamber in the floor between said radial chambers, said coolant supply line opening into said central supply chamber.

4. A heat exchanger as defined in claim 3, wherein each said radial chamber communicates with said central-supply chamber through a slot in said partition.

5. A heat exchanger as defined in claim 4, wherein said slot is oriented in said partition tangential to said radial chamber.

6. A heat exchanger as defined in claim 4, wherein said slot is oriented in said partition radial to said radial chamber.

7. A heat exchanger as defined in claim 1, including an intake for coolant in and at an outer edge of said chambers.

8. A heat exchanger as defined in claim 1, including a port in every section of said ring associated with one of said chambers.

9. A heat exchanger as defined in claim 8, including a line communicating with said port and extending out through said wall and through a sludge-removal valve.

10. A heat exchanger as defined in claim 1, wherein said floor is horizontal and has a diameter shorter than that of said wall; a cone open at the top, said floor being attached by said cone to and above a flange comprising a lower edge of said wall.

11. A heat exchanger as defined in claim 1, including a connection laterally attached to said wall, said floor being vertical and accommodated in said connection laterally attached to said wall.

12. A heat exchanger as defined in claim 11, wherein a line to a sludge-removal valve communicates only with said chambers in said vertical floor.

* * * * *